United States Patent [19]

Wenmaekers

[11] Patent Number: 4,981,238

[45] Date of Patent: Jan. 1, 1991

[54] DISPENSING CAN FOR VISCOUS SUBSTANCES

[76] Inventor: Paul Wenmaekers, 22 bis avenue de Suffren, 75015 Paris, France

[21] Appl. No.: 219,142

[22] Filed: Jul. 15, 1988

[30] Foreign Application Priority Data

| | | | |
|---|---|---|---|
| Jul. 16, 1987 | [FR] | France | 87 10053 |
| May 31, 1988 | [FR] | France | 88 07223 |
| Jun. 20, 1988 | [FR] | France | 88 08224 |

[51] Int. Cl.[5] ..... B65D 83/00; B65D 35/28

[52] U.S. Cl. ..... 222/103; 141/18; 222/95; 222/105; 222/214; 222/558; 222/386.05

[58] Field of Search ..... 222/95, 96, 103, 105, 222/212, 214, 386.5, 517, 556, 558; 141/3, 114, 18, 20

[56] References Cited

U.S. PATENT DOCUMENTS

| | | | |
|---|---|---|---|
| 2,041,488 | 5/1936 | Robinson | 222/558 |
| 2,053,697 | 9/1936 | Cassanos et al. | 222/103 |
| 2,370,995 | 3/1945 | Reed et al. | 222/103 |
| 2,533,839 | 12/1950 | Robinson | 222/103 |
| 2,600,631 | 6/1952 | Freedman | 222/103 |
| 2,613,853 | 10/1952 | Halvorsen | 222/103 |
| 2,816,690 | 12/1957 | Lari | 141/114 X |
| 3,084,722 | 4/1963 | Klingerman | 141/362 |
| 3,464,592 | 9/1969 | Stroop | 222/558 X |
| 4,121,737 | 10/1978 | Kain | 222/95 |
| 4,136,802 | 1/1979 | Mascia et al. | 222/95 |
| 4,147,278 | 4/1979 | Uhlig | 222/94 |
| 4,228,925 | 10/1980 | Mendelovich | 222/103 |
| 4,440,317 | 4/1984 | Clark et al. | 222/103 |

FOREIGN PATENT DOCUMENTS

| | | | |
|---|---|---|---|
| 1210659 | 3/1960 | France | 222/103 |
| 89921 | 9/1967 | France . | |
| 591569 | 2/1978 | U.S.S.R. | 222/558 |
| 511400 | 4/1939 | United Kingdom | 222/558 |

*Primary Examiner*—Ernest G. Cusick

*Attorney, Agent, or Firm*—Nixon & Vanderhye

[57] ABSTRACT

A dispensing can for cosmetic, medicinal or any other type of viscous substances is disclosed. The can comprises a can body provided with a container of the substance and a dispensing head which can be opened or closed under command. The can also has a container consisting of a flexible material and pressure means used to exert permanent pressure on the container in the presence of a substance, enabling the dispensing of the substance upon only a command to open the dispensing head. The invention can be applied to the distribution of food, cosmetic or pharmaceutical emulsions.

25 Claims, 7 Drawing Sheets

DISPENSING CAN FOR VISCOUS SUBSTANCES

BACKGROUND OF THE INVENTION

1. Field of the Invention

The present invention relates to a dispensing can for viscous substances.

2. Description of the Prior Art

At present, dispensing cans for viscous substances usually have a can body in which there is a container of viscous substances made of a semi-rigid material such as aluminium sheeting. The container of viscous substances is connected to a dispensing head and the body of the container is filled with a gas under pressure. The opening of a dispensing valve causes the viscous substance to be expelled outside the can and this substance to be dispensed under the pressure of gas on the semi-rigid wall of the container.

These cans have several drawbacks. These include, for example, the necessarily incomplete deformation of the container made of a semi-rigid material, especially its bottom. The consequence of this incomplete deformation is a substantial loss of viscous substance as it cannot be expelled from a partially deformed container.

Besides normally, and especially when the viscous substance is a medicinal or viscous product, the container and the can body should be coated with a protective varnish. In certain cases, it has been observed that the stability of these varnishes is inadequate for certain substances, resulting in corrosion in the materials that form the body of the can and/or the container, the consequence of which is considerable reduction in preservation and storage times for these substances packaged in this way. The risk of non-functioning of these cans most usually results from the gradual leakage of gas and from the absence of pressure during the use of these cans or from defective dispensing heads. These risks are hardly tolerable when medicinal substances have to be dispensed during swift operation such as, for example, in the case of burns.

Furthermore, in view of the nature of the pressurized gas used, it is not easy to refill these cans with viscous substances and, consequently, their proliferation as consumer objects to be discarded after use creates a considerable problem of rational disposal with a view to avoiding pollution risks. The risk of explosion of these cans, when they are subjected to temperatures of more than 50° C., is also considerable.

SUMMARY OF THE INVENTION

An object of the present invention is to remove the above drawbacks by the use of a dispensing can for viscous substances wherein the container made of semi-rigid material is eliminated and replaced by a container enabling substantially total expulsion of the viscous substance out of the container and the dispensing of this substance.

Another object of the present invention is the use of a dispensing can for viscous substances which can be easily refilled and re-used, thus preventing excessive proliferation of this type of can for one and the same service performed.

Another object of the present invention is the use of a dispensing can of viscous substances in which the propelling gas used in prior art devices can be eliminated.

Another object of the present invention is the use of a dispensing can for high-quality viscous substances wherein the risk of corrosion of the body of the can and of the container are eliminated, said can being more particularly designed for the packaging of medicinal and/or cosmetic substances.

Another object of the present invention is the use of a dispensing can for viscous substances which can be used to generate a flow or a stream of a substance with adjustable dimensions so as to perform different types of medical operations of a therapeutic or cosmetic nature.

The dispensing can for viscous substances according to the invention can be advantageously applied to the packaging and dispensing of viscous substances in liquid or paste form, such as emulsions, substances used as foods such as mayonnaise, mustard and cream products, as well as body hygiene products, shaving creams, depilatory creams or medicinal and cosmetic substances such as sunburn and sun protection creams, creams for bruises or haematoma etc.

BRIEF DESCRIPTION OF THE DRAWINGS

The invention will be better understood from the following description and the appended drawings, of which.

DESCRIPTION OF PREFERRED EMBODIMENTS

Figure 1A:
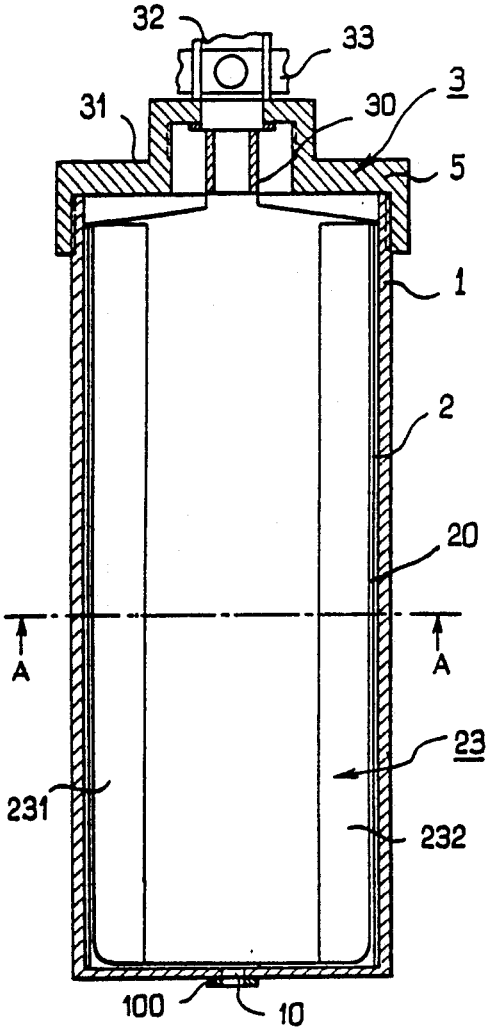
FIG. 1*a* shows a sectional view, along a longitudinal plane of symmetry, of a dispensing can for a viscous substance according to the present invention.

According to the above-mentioned FIG. 1*a*, the dispensing can of viscous substances according to the invention has a can body 1 provided with a container 2 containing the viscous substance to be dispensed. The dispensing can for viscous substances according to the invention also has the dispensing head 3 capable of being opened or closed on command in order to dispense the above-mentioned substance or keep it stored in the can.

According to an especially advantageous aspect of the dispensing can according to the invention, said can has a container 2, made of a flexible material, and means 20, 23, called pressure means, used to exert permanent pressure on the container 2 when a substance is present. The above-mentioned pressure means, associated with the container made of flexible material, enable the dispensing of the viscous substance to be dispensed, upon only a command to open the dispensing head 3.

According to a first and especially advantageous aspect of the dispensing can according to the invention, the container 2 consists of a flexible, elastic material constituting the wall or walls of the container. When the viscous substance to be dispensed is being filled in, these walls are put under mechanical tension and the pressure means 20, in this case, consist, in a non-restrictive way, of the elastic tension of the walls.

According to a non-restrictive embodiment of the dispensing can according to the invention, the pressure means 23 may comprise, in a particularly advantageous way, elastic means that are supported on the internal wall of the can body 1. These elastic means then make it possible to apply the above-mentioned permanent pressure to the external wall of the container 2 constituting a flexible material, and their effect is thus added to the elastic tension effect of the walls of the flexible container 2 when this container is made of elastic material.

It will be understood of course that, depending on the viscous substance to be dispensed, the above-mentioned elastic means may or may not be associated with the flexible container 2 made of an elastic material. The use of an elastic flexible container 2 is especially advantageous because the useful volume of substance may be substantially equal to the internal volume of the body of the can 1.

An especially advantageous embodiment of the elastic means shall be described with reference to the above-mentioned FIGS. 1*b*, 1*c* and 1*d*.

As shown in a cross-section along the plane AA of FIG. 1*a* in the above-mentioned figures, the elastic means consist of two elastic, metallic blades marked 231 and 232. The elastic blades mentioned above consitute springs and the flexible container 2, which may or may not be made of elastic material, is placed between the above-mentioned elastic blades 231 and 232. As shown in the above-mentioned figures, the side end or edge of the elastic blades is supported against the internal wall of the body of the can 1 to form a deformable case in which the flexible container 2 containing the viscous substance to be dispensed is placed.

In an advantageous non-restrictive way, the container 2, made of a flexible material, may advantageously be made of a material compatible with the viscous substance. Thus, the container made of a flexible material may be made of a latex or an elastomer material or any material which can have appropriate physical and chemical stability with respect to the substance to be dispensed. The container 2 may also consist of various materials such as varnished aluminium sheeting, this type of container being capable of taking several refills provided that its circumference is not more than twice the internal diameter of the body of the can 1. Thus, the useful volume is about 36% of the internal volume of the can 1.

FIG. 16 shows the flexible container 2, entirely empty of any substance to be dispensed and held, in this state, between the two elastic blades 231 and 232 which are then substantially flat. On the contrary, in FIG. 1*c*, the set is in an intermediate position: the container 2 contains a sufficient reserve of substance to be dispensed and the elastic blades 231 and 232 permanently exert their pressure on this substance. In FIG. 1*d*, on the contrary, the container 2 has been shown entirely filled with substance to be dispensed, and the elastic blades 231 and 232 are completely pushed against the internal wall of the body of the can 1.

As will be seen in FIG. 1*a*, the upper end of the container 2, made of flexible material, is connected to a tip 30 which is directly joined to the dispensing head 3.

In a non-restrictive way, and according to the embodiment shown in FIG. 1*a*, the dispensing head 3 has a shutter cap 31 for the body of the can 1, this cap 31 comprising an inlet nozzle 32 for the viscous substance to be dispensed. The inlet/dispensing nozzle 32 is, naturally, connected to the tip 30 and may advantageously and non-restrictively comprise a valve 33 capable of being opened and closed under command. The valve may consist of a cock type of system and shall not be described in greater detail since these systems are known per se in the state of the art.

Of course, to provide for dispensing the viscous substance to be dispensed, the nozzle 32 for dispensing the viscous substance is advantageously extended by a dispensing nozzle end 34 which can be adjusted according to the viscous substance to be dispensed and according to the cosmetic and/or medicinal or food-related or hygienic function of the substance.

The dispensing can, according to the invention, can be filled with viscous substances to be dispensed, for example, by means of a pressure pump. The pressure needed for filling may be reduced by using, as shown in FIGS. 1*b* and 1*c* especially, pellets of magnetic material marked 2310 and 2320, said pellets being respectively attached to the external side of the elastic blades 231 and 232. When it is being filled, the can of the invention can be placed between the poles of an electromagnet which provides for the traction of the above-mentioned metallic elastic blades 231 and 232 towards the internal walls of the body of the can 1, thereby reducing the pressure needed for filling the container 2 made of flexible material and, consequently, the pressure of the pressure pump used.

In fact, the viscosity of the product to be dispensed determines the stiffness of the elastic blades 231 or 232 used.

Figure 1B:
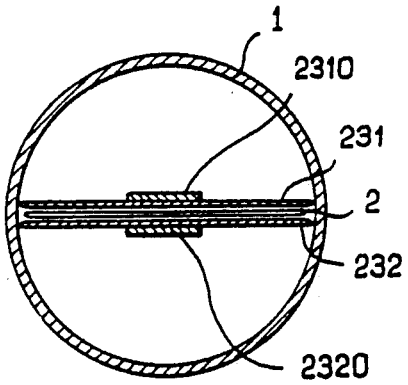
FIGS. 1*b* to 1*d* show a view of the dispensing can according to the invention along a sectional plane AA of FIG. 1*a* in different stages of filling or dispensing of the dispensing can according to the invention and of its container.

The opening of the valve 33 causes, after filling, the immediate expulsion of the viscous product or substance to be dispensed, firstly through the elasticity of the material constituting the flexible container 2 and, secondly, through the effect of the elastic blades 231 and 232 which gradually return to their original position as shown in FIG. 1*b*.

The flexible container 2, for its part, should be made of a material compatible with the product to be dispensed. This material should be highly elastic not only to contribute to the expulsion and dispensing of the viscous substance but also in order to enable several refills of the dispensing can according to the invention.

This possibility of re-using a dispensing can appears to be far more practical and aseptic for cosmetic and/or medicinal products and may prove to be of great value, especially for hospitals as well as for medical services in the armed forces.

As a rule, the viscosity of the viscous substance to be dispensed and the section of the nozzle 32 determines the stiffness of the elastic blades 231, 232 which will preferably have no sharp corners. The elastic blades 231 and 232 may be positioned in the case before, after or during the insertion of the flexible container 2 provided that said flexible container is inserted between the blades as shown in the FIG. 1*b* especially. The mounting of the assembly in the body of the can 1 does not raise any major difficulties. The dispensing head 3 can then be joined to the can 1 body by being screwed into it as shown in FIG. 1*a* especially.

Referring to FIG. 2, we shall now describe an especially advantageous embodiment of a dispensing can for viscous substances according to the present invention and, in particular, an embodiment of an adjustable dispensing nozzle end 34 for the dispensing head 3 capable of being used to dispense a medicinal and/or cosmetic product such as the high-quality products marketed under the brand name "BIAFINE" or "ABI". This product, as is known, is especially efficacious in the treatment of burns caused by overexposure of the skin to sunlight or by exposure of the skin to excessively high temperatures, especially for injuries suffered by fire-fighting personnel. It is also particularly effective in the treatment of bruises and similar injuries.

Figure 2B:
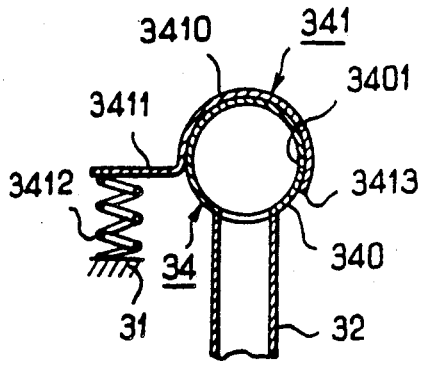
FIG. 2*b* shows a sectional view along a sectional plane BB of FIG. 2*a;*
Figure 2A:
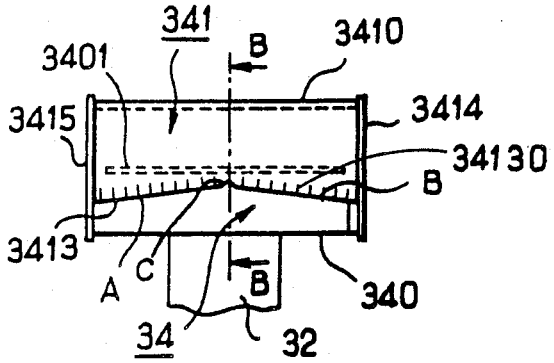
FIG. 2*a* shows a front view of a dispensing head of the dispensing can according to the invention in an especially advantageous embodiment.

As shown in FIG. 2, the adjustable nozzle end 34 for the dispensing of the above-mentioned viscous substance, may advantageously comprise a cylindrical tube 340, said tube being provided, on one of its generating lines, with a slit marked 3401 having a defined aperture width. In addition, the adjustable dispensing nozzle end 34 has a shutter means marked 341 for the slit, said slit shutter means being capable of being controlled to open or shut the slit 3401 made in the cylindrical tube 340. FIG. 2*a* shows an adjustable dispensing nozzle 34 end seen from the front, the slit 3401 being shown in dotted lines since it is shut and hence concealed by the slit shutter means 341.

FIG. 2*b* shows the adjustable dispensing nozzle end 34 in a sectional view along the sectional plane BB of FIG. 2*a*.

In the above-mentioned FIGS. 2*a* and 2*b*, and according to these figures, the slit shutter means 341 may comprise an open cylindrical sleeve-shaped part 3410, said part having, at one of its side edges, an extension 3411 forming a strip to control the slit shutter 341. As can be easily understood from FIGS. 2*a* and 2*b*, the part 3410 is engaged in rotation around the cylindrical tube 341, so that, upon a control from the control strip 3411, the slit shutter means 341 can be used to open or shut the slit 3401 made in the cylindrical tube. As can be further seen in FIG. 2*b* a pull-back spring 3412 can be provided. It is supported on the cap 31, constituting the dispensing head 3, and ensures that the body of the can 1 remains sealed. The above-mentioned spring 3412 is also supported beneath the control strip 3411. In the idle position, the spring keeps the slit 3401 in the shut position, when the control strip 3411 is not actuated.

Of course, the valve 34 having been placed in the open position, the operation of the shutter means 341*n* by opening the above-mentioned slit 3401, enables the dispensing of the viscous substance. Of course, the embodiment as shown in FIGS. 2*a* and 2*b* is not restrictive and, without going beyond the scope of the present invention, the open cylindrical sleeve-shaped part 3410 can be mounted, if necessary, so as to rotate inside the cylinder 340.

An especially advantageous embodiment of the shutter means 341 shall be described with reference to FIG. 2*a*.

According to the above-mentioned figure, in order to dispense the viscous substance with a defined width of flow, especially for a specific use of medicinal substances such as those described above for the treatment of burns, where it is always very difficult to spread the substance throughout the extent of the burn injury, the open cylindrical sleeve-shaped part 3410 may advantageously comprise a shutter edge 3413 at its lateral edge opposite to the lateral edge comprising the extension 3411 forming a control strip, said shutter edge 3413 comprising at least one part which is tilted with respect to the longitudinal axis of the slit 3401. Thus, depending on the pressure exerted on the control strip 3411 and on the corresponding rotation of the open sleeve-shaped part 3410, the length of the slit thus opened, enabling the flow of the substance to be dispensed, varies in direct proportion to the above-mentioned angle of rotation.

As also shown in FIG. 2*a*, the shutter edge 3413 may have two opposite inclined parts A and B, forming a herring-bone shape, the two inclined parts of identical length being connected by a notch marked C, the size of which corresponds to the thickness of the slit 3401. Of course, for the smallest possible angle of rotation of the open cylindrical sleeve-shaped part 3410, the notch C enables, at the most, the opening of a substantially circular hole at the center of the slit 3401, the above-mentioned hole enabling the flow of the viscous substance substantially in a stream, with a diameter close to the aperture width of the slit. For a rotation angle of the open cylindrical sleeve-shaped part 3410, the length of slit opened is symmetrical with the sectional plane BB of FIG. 2*a*, the entire length of the slit 3401 being capable of being opened for the maximum rotation of the open cylindrical sleeve-shaped part 3410.

Of course, in order to facilitate the use, either by personnel administering treatment or by the injured person himself, of the dispensing head 3 and the dispensing nozzle 34 as described especially in FIGS. 2*a* and 2*b*, the open cylindrical sleeve-shaped part 3410 may advantageously have representative graduations 34130 with respect to a reference of the aperture dimension of the slit 3401.

As may be noted in FIGS. 2*a* and 2*b* especially, the sleeve-shaped part 3410 can be mounted by being slipped on to the cylindrical tube 340 between two lateral guides 3414, 3415, also giving the dispensing nozzle end 34 imperviousness. Of course, the fixed reference which enables identification of the graduations and, finally, the opening of the slit can be located on one of the lateral guides 3414 or 3415.

As shall be noted especially in FIGS. 2*a* and 2*b*, the longitudinal axis of the cylindrical tube 340 and that of the open cylindrical sleeve-shaped part 3410 is perpendicular to the longitudinal axis of the viscous substance inlet/dispensing nozzle 32.

Figure 3A:
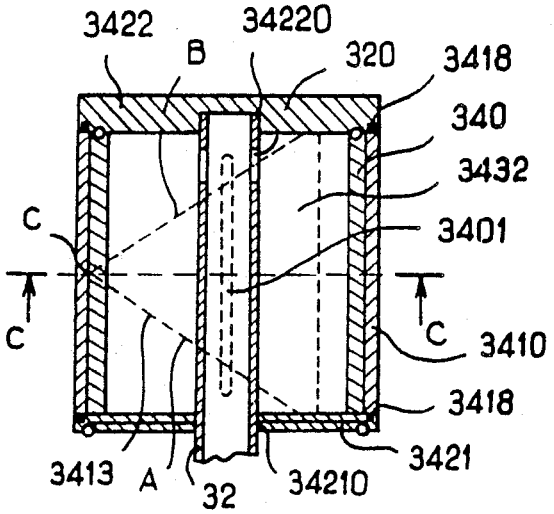
FIG. 3*a* shows a sectional view along a longitudinal plane of symmetry of an especially advantageous embodiment of a dispensing head especially designed for the dispensing of medicinal viscous substances.
Figure 3B:
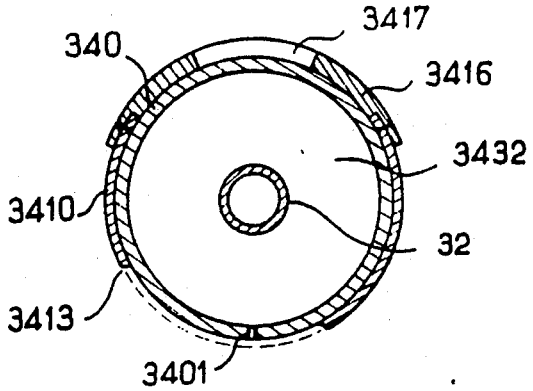
FIG. 3*b* shows a sectional view along a sectional plane CC of FIG. 3*a;*

An especially advantageous embodiment of a dispensing nozzle end 34, especially designed for a dispensing can for viscous substances, such as a medicinal substance which is part of a first-aid kit for operational action personnel, shall be described in relation to FIGS. 3*a* and 3*b*.

According to the above-mentioned figures, the longitudinal axis of the cylindrical tube 340 and of the open cylindrical sleeve-shaped part 3410 is parallel to the longitudinal axis of the viscous substance inlet/dispensing nozzle 32 and lies in the extension of this axis.

In this case, as will be observed, moreover, especially in FIGS. 3*a* and 3*b*, the open cylindrical sleeve-shaped part 3410 and the cylindrical tube 340 each have a diameter which is far greater than the diameter of the viscous substance inlet/dispensing nozzle 32. Thus the viscous substance inlet/dispensing nozzle 32 forms a central shaft with respect to the open cylindrical sleeve-shaped part 3410 and the cylindrical tube 340, and the space between the dispensing nozzle 32 and the open cylindrical sleeve 3410 and the cylindrical tube 340 forms a buffer container in which the viscous substance to be dispensed collects before being dispensed through the slit 3401. Almost all the viscous substance to be dispensed can thus be recovered by the user as shall be described further below in the invention. This recovery can be done in a particularly advantageous way, even when there is no pressure exerted by the elastic, metallic blades, 231 and 232 as described above. Of course, as shall be easily understood when there is no pressure effectively exerted by the elastic blades 231 and 232, with the flexible container 2 being substantially empty, the user then has the possibility of removing the set formed by the cylindrical tube 340 and the open cylindrical sleeve 3410 forming a buffer container, this set being plugged into the dispensing nozzle 32, and of recovering the viscous substance contained in the above-mentioned buffer container in order to use it.

As is shown in a longitudinal section in FIG. 3*a*, the set formed by the cylindrical tube 340 and the open cylindrical sleeve 3410, forming a buffer container, comprises two circular shutter walls for the buffer container. A first circular wall 3421 forms the bottom of the buffer container and has a through hole 34210 and a second circular wall 3422 forms the lid of the buffer container and has a blind hole 34220. The through hole and the blind hole have a diameter enabling the set to be plugged into the inlet/dispensing nozzle 32. In FIG. 3*a*, the space forming the buffer container is marked 3432. In this same figure, dashes are used to show, firstly, the shutter edge 3413 which is not seen in the sectional view, the upper portion of the open sleeve-shaped part 3410 being eliminated and, secondly, the dispensing slit 3401 which is normally made in the upper part of the cylindrical tube 340. Nor is this part seen in the sectional plane of FIG. 3*a*. Of course, the blind hole 34220 can be provided with any standard type of ratchet system that enables the plugging in and suitable fixing of the end of the dispensing nozzle 32. This standard fixing mode will not be described since it can normally be applied by those skilled in the art. Of course, the dispensing nozzle 32 has a dispensing hole 320, for example in its upper part, in order to provide for the flow of the viscous substance to be dispensed in the buffer container 3432. The dispensing slit 3401, placed on the cylindrical tube 340, then enables the flow and the dispensing of the viscous substance to be dispensed, upon actuation of the open cylindrical sleeve-shaped part 3410 by making this part rotate on the cylindrical tube 340.

FIG. 3*b* shows a sectional view along the cross-sectional plane CC of FIG. 3*a*. In this figure, on the open cylindrical sleeve-shaped part 3410, there can be seen an attached part 3416 made of molded material, for example, and designed to enable easier control of the open cylindrical sleeve-shaped part 3410 to open the dispensing slit 3401. The above-mentioned part 3416 may advantageously have a cavity 3417 into which the user can fit a finger or thumb, for example, in order to cause the open cylindrical sleeve-shaped part 3410 to rotate so as to open the dispensing slit 3401 in a manner similar to that of the embodiment of FIG. 2*a*. As shall be noted especially in FIG. 3*b*, the edges forming the shutter edge 3413 of the shutter element 341 may advantageously be bevelled. Of course, in order to ensure that the open cylindrical sleeve-shaped part 3410 is pulled back to the position for shutting and concealing the dispensing slit 3401, the above-mentioned open cylindrical sleeve-shaped part 3410 can be joined to one or more flat coil springs 3418 mounted in a groove of the bottom 3421 or lid 3422. The above-mentioned flat coil spring or springs may be mounted in a groove made in the above-mentioned bottom or lid, and they are joined to the open cylindrical sleeve-shaped part 3410. When there is no action by the user to open the dispensing slit 3410, these flat coil springs bring back the open cylindrical sleeve-shaped part 3410 to the shutter position of the above-mentioned slit. The flat coil springs act in similarly to the flat coil springs used in mechanically driven clockwork devices.

Figure 4:
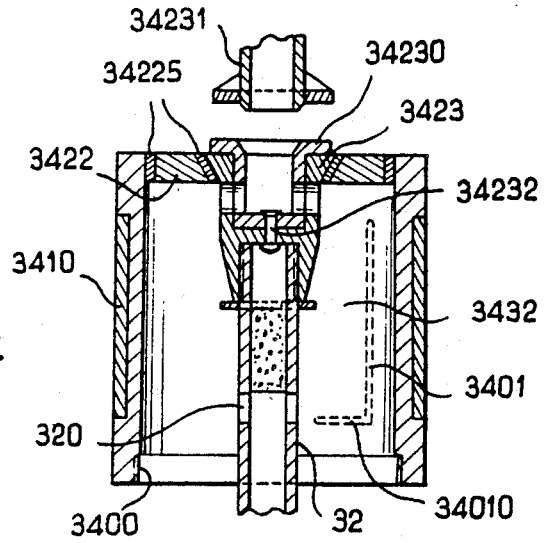
FIG. 4 shows a sectional view, along a longitudinal plane of symmetry, of a special embodiment of the dispensing head shown in FIGS. 3*a* and 3*b* wherein an inlet valve for the substance is provided to ensure the filling or refilling of the container of the dispensing can according to the invention.

An especially advantageous alternative embodiment of the dispensing nozzle end 34, as shown in FIGS. 3*a* and 3*b* above, shall be now described in relation to FIG. 4. This embodiment enables the filling and/or refilling the dispensing can according to the invention and the dispensing of the viscous substance in the easiest and most aseptic conditions possible for cosmetic and/or medicinal substances.

As shown in FIG. 4, with the valve 33 being eliminated at the inlet/dispensing nozzle 32, the wall 3422 forming a lid can be fitted with a valve 3423 which is directly connected to the inlet/dispensing nozzle 32. The valve 3423 has an external female tip 34230 enabling the flexible container 2 to be filled with a viscous substance, through a male tip 34231 connected to a reserve of viscous substance under relative overpressure compared with the internal cavity of the flexible container 2. The valve 3423 is shown directly connected to the dispensing nozzle 32, the valve 3423 being provided in a standard way with a non-return valve 34232. Instead of a bottom wall, the cylindrical tube 340 may be provided at its end with a thread 3400 enabling it to be screwed onto the shutter cap 31 of the can 1. It will be noted, in particular, that the dispensing slit 3401 may be provided with an extension 34010 the function of which shall be described below. Furthermore, the lid 3422 can be provided with weaker zones 34225 as shown in FIG. 4. With the dispensing slit 3401 concealed, injection under pressure is achieved, the buffer container 3432 being filled with viscous substance under pressure and flowing through the hole 320 of the inlet nozzle 32 towards the flexible container 2. Because of the specially adapted shape of the weaker zones 34225, with the cap 3422 forming a keystone type of assembly which suitably shuts the buffer container 3432, the substance flows through the hole 320 of the inlet nozzle 32 to the flexible container 2 and fills it. Similarly, with the container being filled, as also the buffer container 3432, the opening of the dispensing slit through the control of the open cylindrical sleeve-shaped part 3410 has the effect of causing the viscous substance to be dispensed with a flow width as described with reference to FIG. 2*a*. When the flexible container is empty, the container 2, the buffer container 3432 is filled with viscous substance to be dispensed but without pressure. The lid 3422 is no longer subjected to pressure, and a simple force exerted on it inwards with respect to the buffer container 3432 has the effect, with the slit 3401 and especially its extension 34010 opened, of causing the viscous substance contained in the buffer container 3432 to be recovered, with the lid 3432 then acting as a piston. Furthermore, the viscous substance to be dispensed can also, in certain cases, be recovered by dosing at the choice of the user, especially when the user is in a hospital environment. The dispensing nozzle as shown in FIG. 4 is especially advantageous inasmuch as refilling requires no dismantling. However, in hospitals, it is recommended not to use the reserve product contained in the buffer container 3432 before refilling in order to preserve aseptic conditions.

Of course, the body of the can 1 may consist of a rigid material such as, for example, aluminium sheeting or even a semi-rigid material or flexible material such as polyvinyl chloride for example. In this case, and especially when the container 2 itself consists of an elastic material in the absence of elastic means consisting of spring-forming elastic blades 231 and 232, the user may exert manual pressure on the body of the can, for example, in order to ensure better dispensing of the substance.

As shown in FIG. 1*a* especially, the body of the can 1 may comprise at least one vent marked 10, and the said vent may or may not be provided with a valve marked 100.

The vent 10 and the valve 100 may advantageously be used to make the dispensing can for this substance, according to the invention, especially suited to use and re-use by refilling on the operation site and, especially, for use under the most efficient aseptic conditions.

Preferred means used to enable, in particular, the filling of viscous substances for treatment according to the invention, shall now be described with respect to FIGS. 5 and 6.

Figure 5:
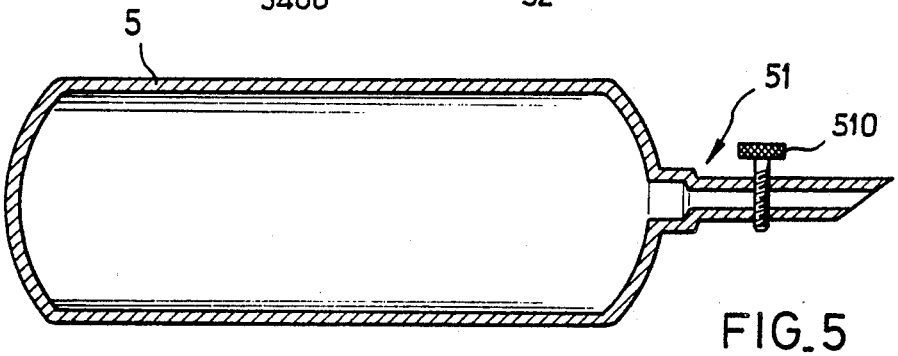
FIG. 5 shows a sectional view, along a longitudinal plane of symmetry, of a refill cartridge for a dispensing can according to the invention.

According to FIG. 5, in order to enable the refilling of the flexible container 2, the means for refilling the above-described dispensing can according to the invention may comprise a refill cartridge comprising a rigid cartridge body 5 defining a volume greater than the internal volume of the body of the can 1 of the dispensing can according to the invention. The body 5 of the cartridge is provided with a coupling head 51 for coupling with the valve 100 of the vent 10. The volume of the cartridge body has, for example, a primary vacuum, i.e. a vacuum of the order of $10^{-4}$ Torr, for example. Of course, the coupling head 51 is provided with a valve marked 510.

Figure 6:
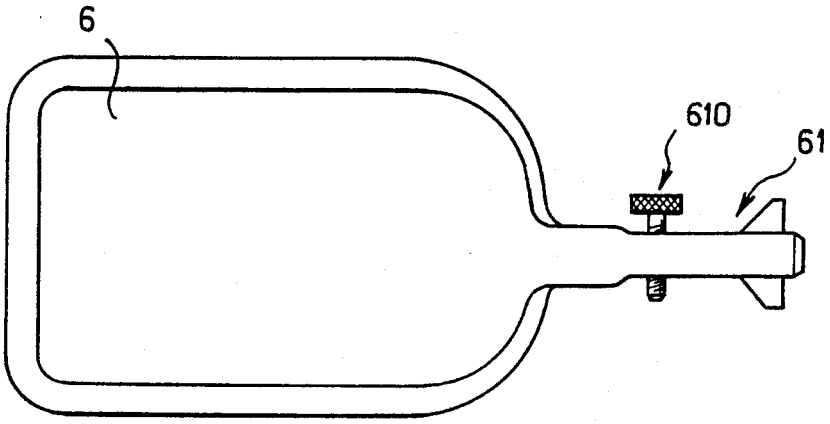
FIG. 6 shows an isometrical view of a reserve filler cartridge for a container of a dispensing can according to the invention.

Furthermore, to fill the flexible container 2, the refill means also comprise, as shown in FIG. 6, a reserve filler cartridge for the above-mentioned container. The reserve filler cartridge shown in FIG. 6 has, for example, a cartridge body made of a flexible material 6, said material being naturally compatible with the viscous substance used for treatment. Of course, the reserve of viscous substance is under over-pressure with respect to the internal cavity of the flexible container.

In an advantageous embodiment of the device according to the invention, namely the dispensing can as described above, and the refill cartridge and the reserve filler cartridge, the latter may advantageously consist of a cartridge body made of a flexible material, the cartridge body being filled at substantially ambient pressure. Of course, the body of the cartridge 6 has a male dispensing head 61 which corresponds substantially to the male tip 34231 shown in FIG. 4. Of course, the dispensing head 61 has an opening control valve 610.

With the reserve filler cartridge having been coupled to the valve 3423 and with the valve 610 being kept closed, it is then enough for the user to engage the refill cartridge 5, and, especially, the coupling head 51 in the valve 100 of the vent 10 of the body of the recipient 1, the valve 510 of the coupling head 51 being, of course, kept closed. The successive actuation, at opening, of the valve 610 of the reserve filler cartridge and then of the valve 510 of the refill cartridge enables the filling of the flexible container 2 with the viscous substance used for treatment, through the depression created in the casing of the can 1, around the said flexible container 2. The body, made of flexible material, of the reserve filler cartridge 6 can be used, of course, to ensure the proper filling of the flexible container 2.

Of course, the above-described refill method can be applied essentially for refilling on an operational site or an action site. Of course, the refilling can be done simply with a pump used to inject the considered viscous substance under pressure, with, if necessary and depending on the degree of viscosity of the substance, the use of an electromagnet which reduces the resultant stiffness of the springs in view of the presence of the magnetic parts 2310 and 2320, as shown in the FIGS. 1*b* or 1*c*.

We have thus described an especially efficient dispenser of viscous substances which can be used to dispense food products as well as cosmetic and/or medicinal substances. In the latter case, the embodiments of FIGS. 3*a*, 3*b*, and 4 appear to be especially advantageous since, for the use of medicinal or cosmetic emulsions such as BIAFINE, a buffer container with a capacity of 50 ml can be used, in any case, even when there is no pressure exerted to dispense this substance to a wounded person, to recover the content in order to provide immediate aid.

Furthermore, after shutting the dispensing slit with the open cylindrical sleeve-shaped part, the viscous substance remaining in the slit is sheltered from air and filth, and there is no risk of desiccation of this substance, since it remains in contact with the mass of the substance contained in the buffer container.

While the above described can is satisfactory in its functioning, the use of the can to dispense medicinal viscous substances for therapeutic or cosmetic purposes require the use of a container 2 made of a high-quality compatible material, thus making the dispenser relatively expensive.

A special embodiment is aimed at using a can that gives satisfaction from every operational point of view, under storage and packaging condition of the first order, especially for medicinal viscous substances but with substantially reduced manufacturing and using costs.

The above-mentioned result is achieved, in the embodiment of the present invention, by the elimination, from the above-described dispensing can for viscous substances, of the flexible container 2 consisting of a very high quality bag.

A distinguishing feature of the dispensing can for viscous substances, according to the embodiment considered, is that the container 2, made of a flexible material, is formed by elastic means 23, consisting of two elastic blades 231, 232 forming springs, one end of the lateral edge of the elastic blades being supported against the wall of the body of the can 1, to form a deformable case constituting a receiving chamber for the viscous substance to be dispensed, one upper diaphragm and one lower diaphragm, said diaphragms being respectively joined, firstly, to the upper edge and the lower edge of the body of the can and, secondly, to the upper and lower edges respectively of elastic blades to form a vacuum chamber surrounding the said chamber for the reception of the viscous substance.

The above-mentioned embodiment can be applied to the storage and packaging of viscous substances of all types and is particularly suited for application in low-cost, large-scale production.

The embodiment of the dispensing can for viscous substances shall be described, firstly, in relation to FIGS. *7a* to *7c*.

As shown in the above-mentioned figures, the container 2, made of a flexible material, is formed by the elastic means consisting of two elastic blades 231 and 232 forming springs, one end of the lateral edge of the elastic blades being supported against the internal wall of the body of the can 1 to form a deformable case constituting a receiving chamber 2300 of the viscous substance to be dispensed.

Furthermore, an upper diaphragm marked 51 and a lower diaphragm marked 52 are provided. These diaphragms 51 and, as seen in FIGS. *7a–7c* are respectively joined, firstly, to the upper edge and lower edge of the body of the can, and secondly, to the upper and lower edge respectively of the elastic blades 231 and 232. The upper diaphragms 51 and 52, the internal part of the body of the can 1 and the elastic blades 231 and 232 thus form a vacuum chamber marked 2311 and 2321 surrounding the reception chamber for the viscous substance, said reception chamber being marked 2300.

Figure 1C:
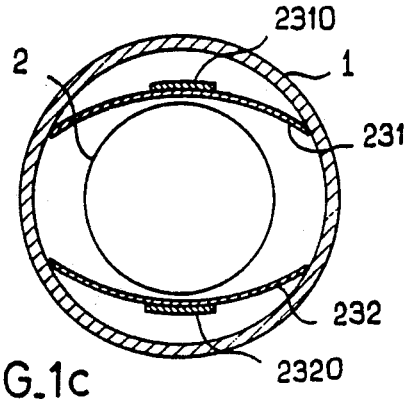
Figure 1D:
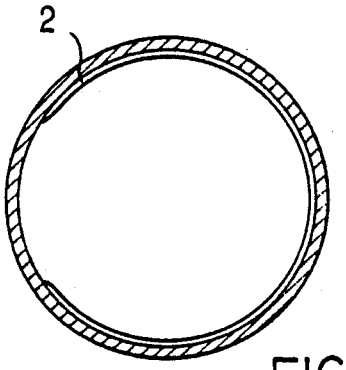

As a non-restrictive example, the diaphragm 51 and 52 may consist of a material such as rubber for example, the edges of the diaphragm being joined to the upper end and the lower end of the elastic blades 231 and 232, these elastic blades being, for example, vulcanized on the latter and the edges of the diaphragm joined to the upper edge and the lower edge of the body of the recipient 1 being capable of being mounted, for example, by means of a threaded ring marked 510 and 520 in the above-mentioned FIGS. 1*a*, 1*b* and 1*c*.

It will be noted that the diaphragms may be made of high-quality rubber, this quality being sufficient to ensure the sole function of shutting the vacuum chamber 2311, 2321 and, finally, to demarcate the reception chamber 2300 for the viscous substance to be dispensed. Of course, the term vacuum chamber 2311, 2321, corresponds to the designation of the above description as opposed to the reception chamber 2300 which is designed to receive the viscous substance to be dispensed.

In order to ensure efficient conditions for the storage of the viscous substance to be dispensed, especially when this substance is a medicinal substance with cosmetic or therapeutic properties or by a food product or substance, the reception chamber 2300 of the viscous substance to be dispensed being finally demarcated partly by the side surface of the elastic blades 231, 232, these blades, which form springs, may consist of steel blades with a thickness ranging between 8/100th and 15/100th of a millimeter. The above-mentioned blades may then advantageously have a varnished, aluminium coating, said coating enabling the storage of the viscous substance to be dispensed in optimum preservation conditions.

Similarly, after suitable machining, the internal wall of the body of the can may, after suitable machining which enables the free sliding of the lateral edges of the elastic blades during the filling of the reception chamber 2300 or during the dispensing of the viscous substance, comprise an identical coating of varnished aluminium. It will be noted that, in the above-mentioned FIG. *7a*, by way of simplification, the dispensing head 3, which is substantially identical to the dispensing head 3 shown previously in the description, is not being shown in order to avoid cluttering the drawing.

An alternative and especially advantageous embodiment of the dispensing can for viscous substances according to the invention in the above-mentioned embodiment shall be described with reference to FIGS. 8*a* and 8*b*.

Figure 8A:
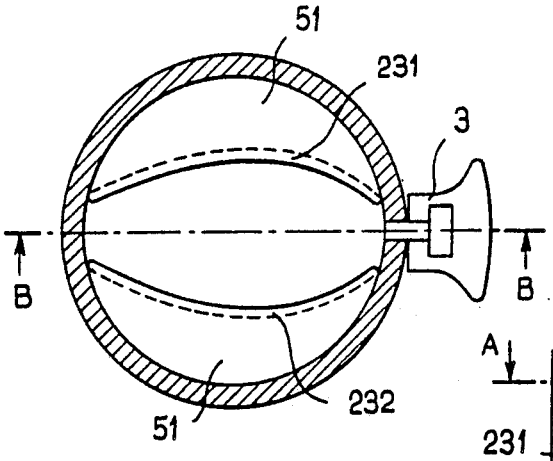
FIG. 8*a* shows a front view of a section, along a cross-section plane marked AA in FIG. 8*b*, of an alternative embodiment of a can according to the invention, according to the above-mentioned non-restrictive embodiment.
Figure 8B:
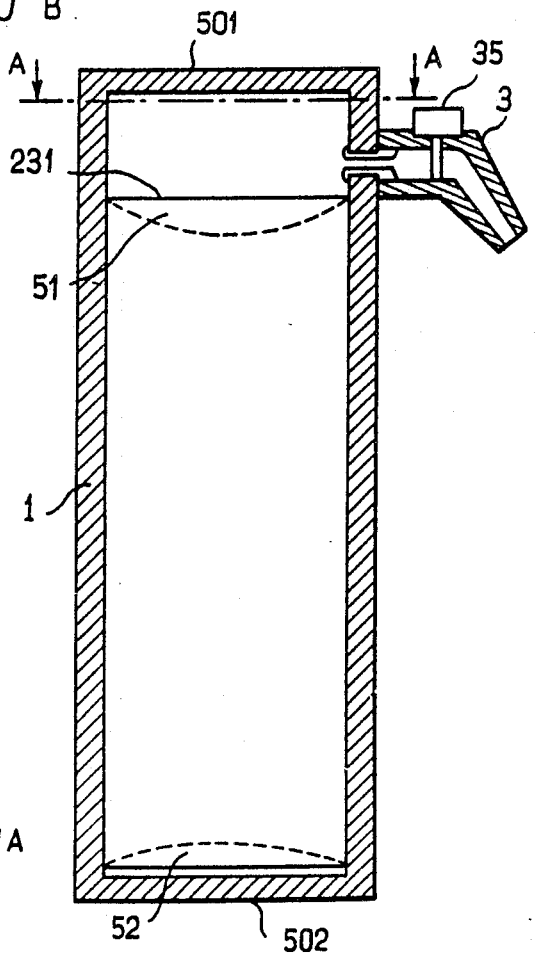
FIG. 8*b* shows a side view of a section, along a plane of symmetry marked BB in FIG. 8*a*, of a can according to the invention.

With reference to the above-mentioned FIGS. 8*a* and 8*b*, the body of the can 1 is made up of a cylindrical element with two heads 501, 502, the above-mentioned heads being closed. In this case, the elastic blades 231 and 232 have a length smaller than that of the body of the can formed by the cylindrical element 1 and lie in the neighborhood of one of the closed heads, the diaphragms 51 and 52 being mounted in the same way as described above with reference to FIGS. *7a*, *7b* and *7c*.

According to FIGS. 8*a* and 8*b*, the dispensing head can be opened and closed under control by means of a push-button 35 controlling a valve and placed laterally on the lateral surface of the body of the can 1. Of course, the dispensing head 3 is placed between the upper end of the elastic blades 231, 232 and the closed head which is at a distance from this end, the head 501 in FIG. 8*b*.

Figure 7A:
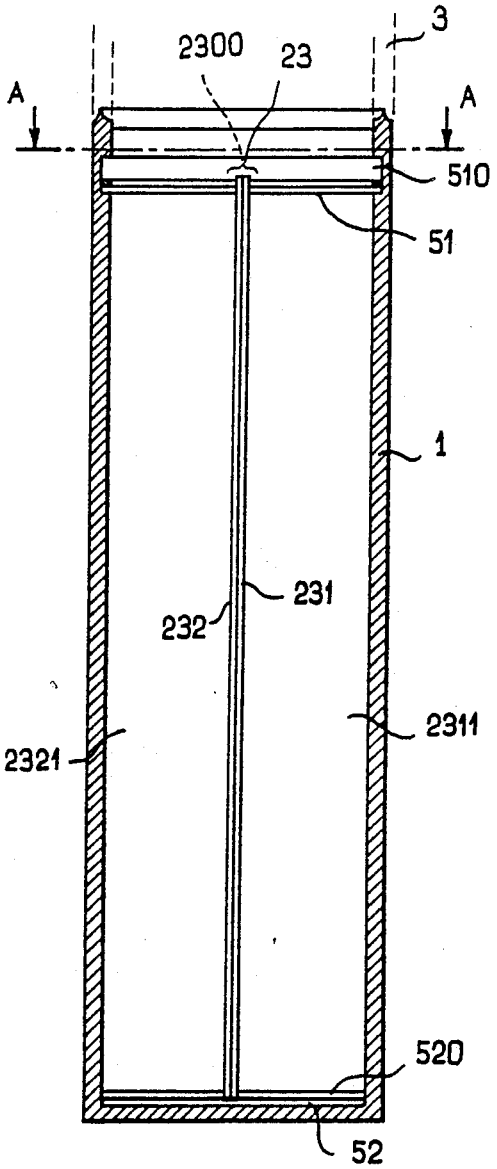
FIG. 7*a* shows a front view of a section, along a plane of symmetry marked BB in FIG. 7*b* of a can according to the invention, in a special non-restrictive embodiment.
Figure 7B:
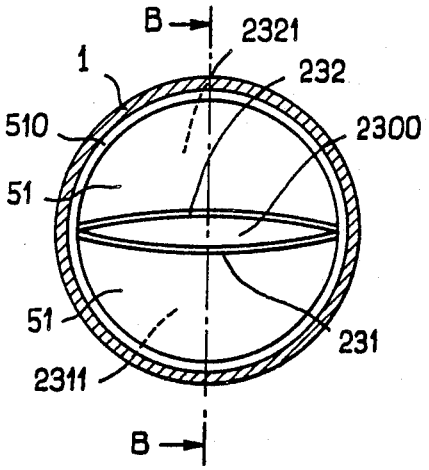
FIG. 7*b* shows a front view of a section, along a cross-section plane marked AA in FIG. 7*a*, of a can according to the object of the invention, where the case designed to receive the viscous substance to be dispensed is substantially empty.
Figure 7C:
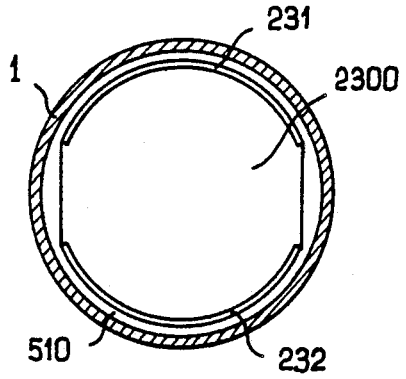
FIG. 7*c* shows a view of a can according to the invention according to FIG. 7*b* where the case designed to take the viscous substance to be dispensed is filled.

It will be noted that FIG. 8*b* has not been drawn to scale and that, in particular, the volume between the free end of the blade 231, 232 supporting the diaphragm 51 and the can head 501 can be made as small as possible with respect to the volume of the receiving chamber 2300 so that the volume of non-dispensed viscous substances remaining in this dead volume when the blades 231 and 232 are in compressed position, as shown in FIG. 7*b*, is finally very low. It will also be noted that the dispensing head 3 may be of a standard type, the push-button 35 being used to actuate a valve for the opening and closing of said dispensing head 3. Consequently, this dispensing head shall not be described in detail as it is perfectly known to those skilled in the art.

Figure 8C:
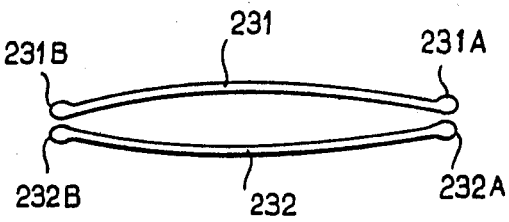
FIG. 8*c* shows an especially advantageous, non-restrictive embodiment of elastic, metallic blades or springs.

Finally, to improve the sliding of the lateral end of the elastic blades 231, 232 on the internal wall of the body of the can 1, the elastic blades mentioned above, can advantageously comprise, as shown in FIG. 8*c*, an enlargement with a rounded section marked 231A, 231B, 232A, 232B. This enlargement can be prepared when making the above-mentioned elastic blades or it may be attached and may consist of a cylindrical rod made of polytetrafluorethylene for example, the cylindrical rod covering the entire side end mentioned above. In this case, the polytetrafluorethylene rod may have a diameter of a few millimeters and may be slit along one of its generating lines with the side edge of the corresponding elastic blade being inserted in the above-mentioned slit and fixed to it by thermocompression or by bonding for example.

We have thus described an embodiment of the dispensing can for viscous substances according to the invention, which is especially advantageous inasmuch as it can be manufactured in large batches at a reasonable cost price while maintaining the properties of storage quality and preservation of the viscous substance to be dispensed.

To constitute the elastic means, the above-described can preferably comprises two elastic blades 231, 232 forming springs between which the flexible container 2 is placed. An end of the side edge of the elastic blades is supported against the internal wall of the body of the can 1 to form a deformable case in which the flexible container is placed.

Although the above-mentioned can is satisfactory in its working principle, there are practical difficulties in making it or, at least, difficulties in the optimizing of components for rational manufacture and operation. Thus, to apply suitable pressure to the container case, the elastic blades 231, 232 should have a section of a thickness less than or equal to 5/10 mm. Thus, during the use of the can, i.e. when the elastic blades return to their contiguous position, after the dispensing of the viscous substance, the sharp edge of the elastic blades forming springs is supported on the internal wall of the can body and applies shearing strains to it, whether the body of the can is made of plastic or even of aluminium. Furthermore, in these conditions, the elastic blade exert practically cease to exert sufficient effort when they return to their initial position.

Figure 9:
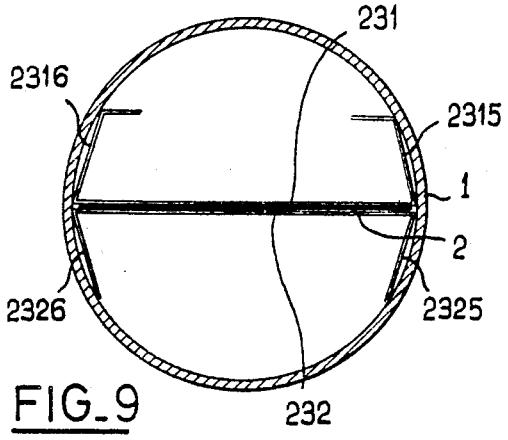
FIG. 9 shows a cross-sectional view of a first embodiment of the shielding element for the edges of the elastic blades forming springs.

In another non-restrictive embodiment shown at FIG. 9, the dispensing can for viscous substances can be used to cope with the above-mentioned disadvantage. A remarkable feature of this dispensing can is that, in order to reduce the shearing strains at the ends of the lateral edge of the elastic blades on the internal wall of the can body, the edges of the springs are provided with a shielding element.

The shielding element may consist of a frame to shield the internal wall of the can body, contained within the can body. The elastic blades are housed in the shielding frame and have free clearance to provide for filling or restoring and dispensing the substance.

The dispensing can of viscous substances, in its above-mentioned embodiment, shall be described firstly with reference to FIG. 9.

According to the above-mentioned figure, and in order to reduce shearing strains by the ends or lateral edge of the elastic blades 231, 232 on the internal wall 1 of the can body, the edges of the above-mentioned elastic blades are provided with a shielding element.

According to FIG. 9 mentioned above, constituting a non-restrictive embodiment, the shielding element may comprise U-shaped elastic blades 231, 232 forming springs. In this case, however, with the elastic blades 231, 232 being folded back so as to have a U-shape, the shearing effect is reduced but the resistances of the folding angles appear during the filling of the case, i.e. when the substance to be dispensed is let into the case 2 forming a container. The U-shaped configuration mentioned above provides, however, for efficient restoration of the substance to be dispensed. On FIG. 9, the lateral folded wings of the blades 231, 232 are marked 2315, 2316, 2325 and 2326.

Figure 10:
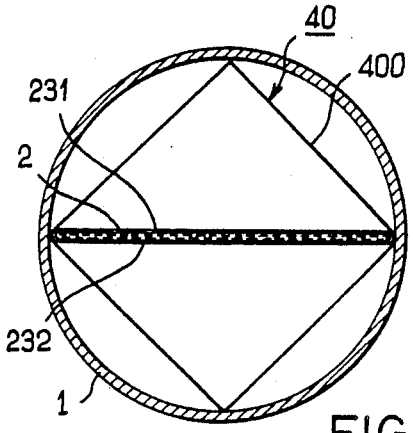
FIG. 10 shows a cross-sectional view of a second preferred embodiment of the shielding element for the edges of the elastic blades forming springs.

According to another more particularly advantageous embodiment, shown in FIG. 10, the elastic blades 231, 232 may be provided with a shielding element, said shielding element consisting of a frame marked 40, known as a shielding frame for the internal wall, in which the elastic blades 231 and 232 are housed. The elastic blades 231 and 232 have free clearance to enable the filling or restoring and dispensing of the substance to be dispensed.

As can be seen in FIG. 10, the shielding frame 40 may advantageously consist of a metallic support 400 with a substantially square section, the apexes of which are supported on the internal wall of the body of the can 1. The elastic blades 231, 232 are then mounted along a diagonal of the substantially square section, the lateral edges or ends of the elastic blades 231, 232 being supported on the internal wall of the opposite apexes of the section of the support 400. The shielding frame may consist of two identical spring type steel angles corners with a thickness of two tenths of a millimeter. The angle at the tip of the diagonal receiving the elastic blades 231, 232 may be, for example, slightly greater than 90° so as to facilitate the clearance of the above-mentioned elastic blades 231 and 232 during the can is being filled with viscous substance to be dispensed and when this viscous substance is restored when the springs or elastic blades 231, 232 apply their pressure to the container case 2 to enable the dispensing of the above-mentioned viscous substance.

Of course, the shielding frame 40 may consist of a support 400 extending along the entire length or a part of the length of the body of the can 1. This feature can be seen especially in FIG. 11*a* where, in particular, the support 400 constituting the shielding frame 40 has been shown.

The two rectangular angles are arranged so that their adjacent free edges, forming the tips of the diagonal which do not have the elastic blades 231, 232, are contiguous but are capable of acting freely. Thus, through its natural elasticity, the support 400 enables the boosting of the effect of the elastic blades 231, 232, on their return when the viscous substance is being dispensed.

Figure 11A:
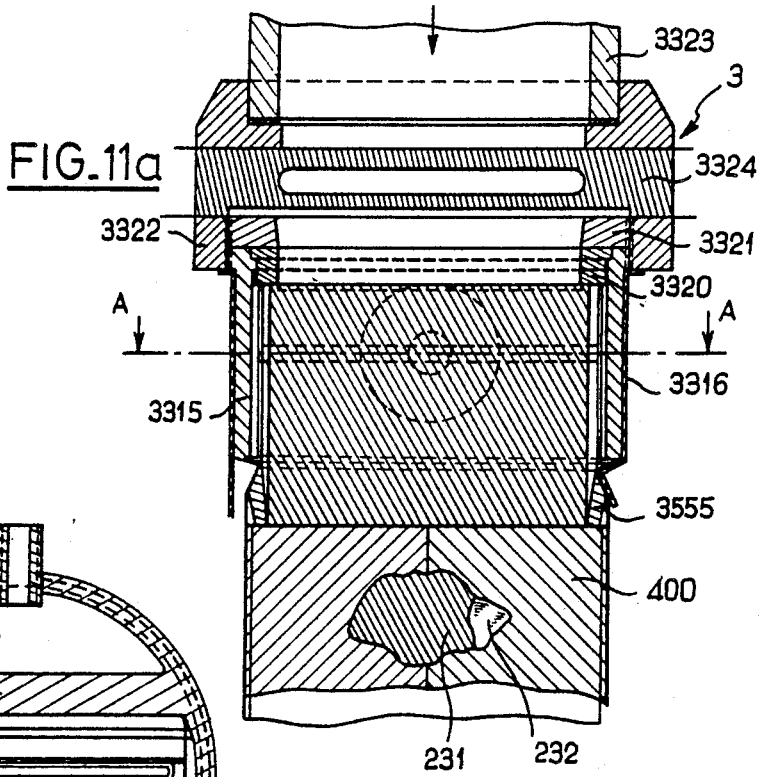
FIG. 11*a* shows a longitudinal sectional view of the arrangement of the elastic blades forming springs in the body of the can.
Figure 11B:
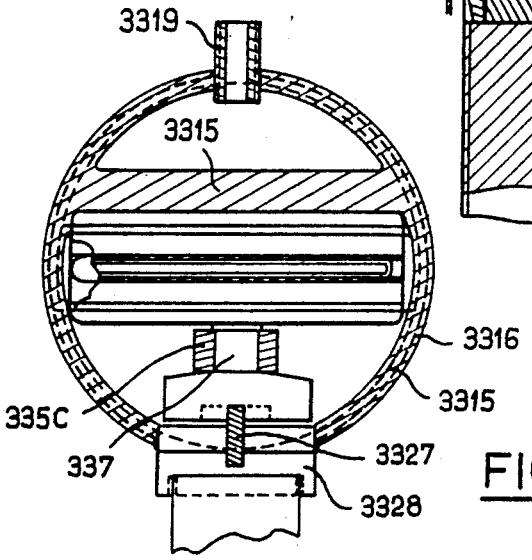
FIG. 11*b* shows a cross-sectional view of FIG. 11*a* along a sectional plane AA of FIG. 11*a*.
Figure 12:
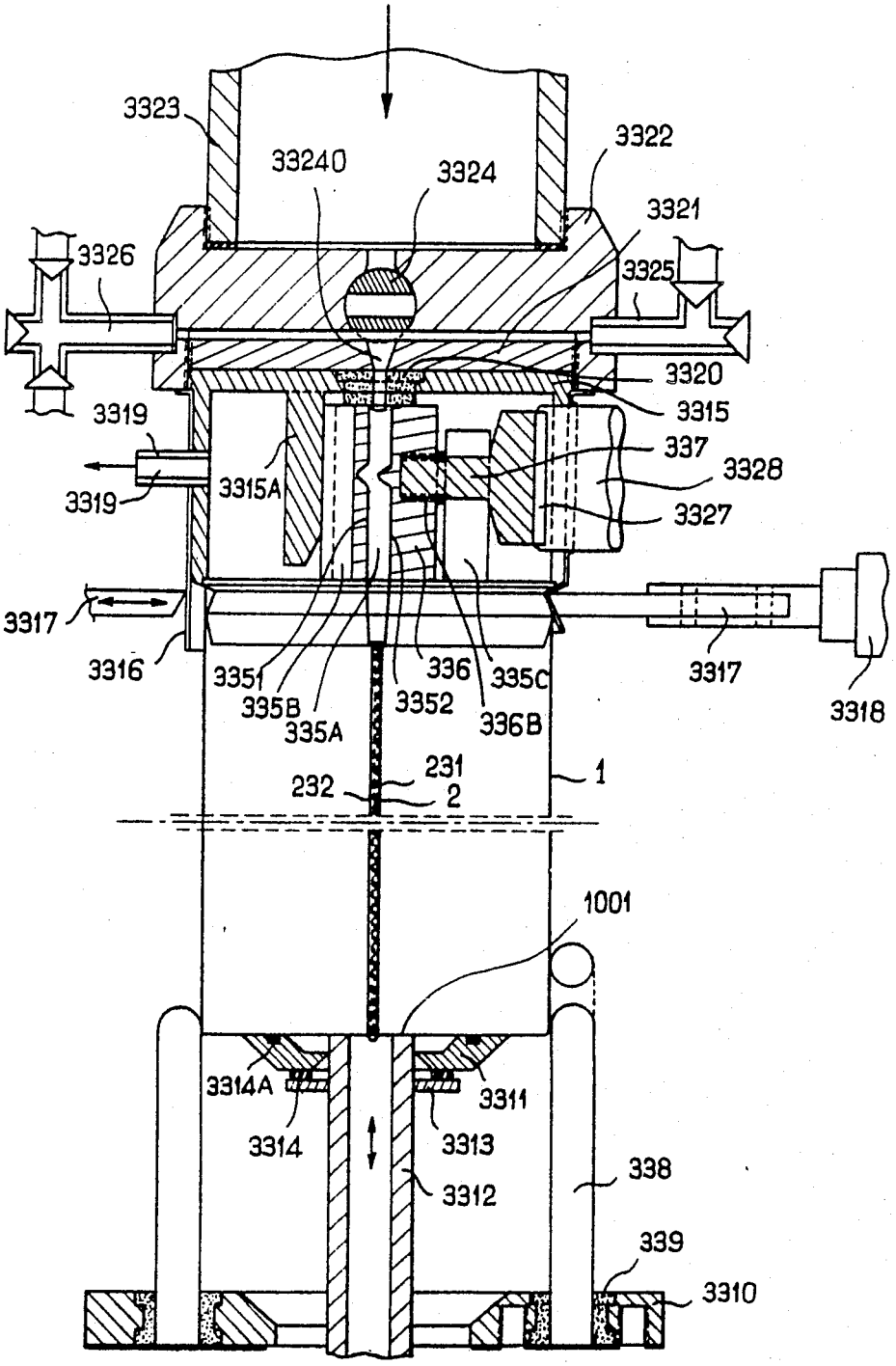
FIG. 12 shows a longitudinal sectional view of a can, according to the invention, during assembly and manufacture.

A more detailed decription of the can according to the invention in the above-mentioned embodiment shall now be given with reference to FIGS. 11*a*, 11*b* and 12.

In the above-mentioned figures, the dispensing head 3 of the substance to be dispensed may consist of an injected plastic material.

The dispensing head 3 may advantageously have an upper cup 3315, which is molded and is used as a support for the entire body of the can 1. It also has a ring 3322, for the inlet and outlet of the viscous substance, capping the upper cup 3315 and a valve 3324 to let in the viscous substance when the can is being filled with this viscous substance.

As shown in FIG. 12, there is provided a channel 33240 which makes the inlet valve 3324 communicate with the case 2 forming a container. A fixed support 335B of the case forming a container 2 is used to receive a first external side of the case 2, said first external side of the case 2 being connected to the fixed support 335B. The first external side of the case may be joined, by bonding for example, to the fixed support 335B. A movable support 336 of the case forming a container 2 is also provided wherein the second external side of the case is attached in a way similar to that of the first external side. The movable support 336 is movable with respect to the fixed support 335B so as to enable the case 2, forming a container, to be put in communication with the channel 33240. There is provision for a molded centering piece 3315A on which the fixed support 335B rests. The centering piece 3315B is mechanically joined to the upper cup.

A knurled screw 337 goes through the side wall of the upper cup 3315 and provides for the control of the movable support 336, of the case forming a container, through the engagement and release of this movable support 336 with respect to the fixed support 335B thus enabling the closing or opening of the connection of the channel 33240, which sets up communication, and of the case forming a container 2.

According to an advantageous embodiment, the movable support 336 of the case forming a container 2 and the fixed support 335B of this same case each have an elastic blade 3351, 3352 joined to the fixed support 335B and a movable support 336 respectively. Each blade may consist of an extension of an elastic blade 231, 232, and may form, firstly, a linking channel 335A for the viscous substance between the inlet valve 3324 and the container case 2, when the movable support 336 is in the released position with respect to the fixed support 335B of the case 2 and, secondly, a sealing safety valve when the movable support 336 is the engaged position on the fixed support 335B of the case.

In order to provide imperviousness, each blade has at least one notch and one step, respectively, as shown in FIG. 12, especially so as to ensure the closing of the connecting channel 335A when the movable support is in the engaged position on the fixed support of the case.

According to an advantageous feature of the can in the above-mentioned embodiment, the body of the can 1 may be formed by a tube or sleeve joined by crimping to the edge of the upper cup. For this purpose, the upper cup may comprise a connecting ring 3555 enabling the crimping of the tube or sleeve which may be made of aluminium for example. The tube or sleeve forming the can body has, at its end, opposite the end connected by crimping, a hole 1001 provided with a centering cone 3313. The hole 1001 is a hole that goes through the wall of the can body 1 to enable the space between the internal wall of the can body 1 and the external wall of the container case 2 to be put under depression. Furthermore, as shown in FIG. 12, the valve 3324 for the inlet of viscous product is formed by a cylindrical bolt whirling in the viscous substance inlet and outlet ring 3322. A hole is made in the whirling cylinder along a diametral plane of this cylinder.

In FIGS. 11*a*, 11*b* and 12, 335A designates a passage for a case constituting a linking channel for the viscous substance between the inlet valve 3324 and the container case 2 in the released position of the movable support 336 with respect to the fixed support 335B of the case and 335*c* designates a bearing block for the screw 337. The screw and the knurling 337 actuate the movable support 336 of the case 2 forming a container.

An example of an assembly of a can according to the above-mentioned embodiment shall be described in relation to FIG. 12. The shielding frame 40 formed by the support 400 is introduced first into the can body 1 formed, for example, by a metallic aluminium tube. The elastic blades forming springs 231, 232, have the same height as the shielding frame 40. The width of the elastic blades 231, 232, depends on the thickness of the case 2 forming a container. Preferably, the latter will be formed by a flat case made of crude latex. The elastic blades 231, 232, abut the internal corners of the shielding frame 40. The flat elastic case 2 has a width which is slightly smaller than that of the elastic blades 231, 232, but, preferably, the height of the elastic case 2 corresponds to the height ranging between the top of the dispensing head 3 and the bottom of the can body 1.

However, it is possible to bring the elasticity of the container case 2 into play in order to have standard cases for different heights of can bodies 1. The dispensing head 3 is planned as a single part because it can be made of an injected plastic material for cans produced in large batches. The shaping of the connection ring 3555 will provide for the connection with the box or body of the can 1.

It will be noted, in particular, that the movable support 336 and the fixed support 335 respectively have a projecting part and a groove, these two parts having a different angle in order to obtain imperviousness to the external air at the flat part between the two lips of the container case 2 and imperviousness to internal pressure exerted by the elastic blades 231, 232.

It will also be noted that the movable support 336 is provided with two side fins which prevent bulges from forming in the case. The support 336 receives the screw 337 by a threaded hole 336B which should have sufficient depth to enable a movement of 3 to 4 mm. in the movable support 336. This gap between the lips of the container case 2 is needed only for sterilizing and rinsing the case as well as to fill the can described herein, whereas the aperture for use may be tiny depending on the packaged product and its use. It will be understood, of course, that, with the can filled, the viscous substance can be dispensed through the dispensing nozzle 3 as described previously in the description.

The packaged product may determine the thread pitch, but when it is desired to package the viscous substance automatically it will be useful for the opening and, especially, the closing of the connection channel 335A through the screw 337 to be a multiple of half a turn of this screw. To this end, the screw and the knurling 337, activating the movable support 336, may be provided with a slit for screwdrivers and centering guides.

To assemble a can according to the invention, as shown in FIG. 12, advantage is taken of the relative impossibility of bonding the latex that constitutes the container case 2, and the top part of the fixed support 335B and of the movable support 336 are coated with bonder. The container case 2 is engaged and its upper part is clamped between the fixed support 335B and the movable support 336. The elastic blades 231, 232 are also coated with bonder and applied to the lower part of the container case 2, the entire unit being engaged between the shielding frame 40 so that the bottom abuts it. The fact that the upper part of the can body 1 is pressed against the groove 3555 of the connecting ring, the upper cut face of which causes the rising movement, by one tenth or two tenths of a millimeter, enables the movement of the springs but prevents bulging in the container case 2.

During refilling, namely when the viscous substance to be dispensed is let into the container case 2, the elastic blades 231, 232 come unstuck from the container case 2 while the lips of this case, which undergo virtually no traction, are bonded to the fixed support 335B and the movable support 336.

It must be noted, however, that the container case 2 contains no air at all and can be easily packaged under pressure by providing for a special nozzle for a long and narrow opening.

But these cases, which are delivered as manufactured, sometimes have to be washed, sterilized and dried before the packaging of the viscous substance to be dispensed.

These operations can be done immediately before the filling, namely before letting in the viscous substance to be dispensed, and can be done with the same machine.

To this end, the can of the invention is assembled but not crimped, and is placed in a lower cup joined to a pneumatic or hydraulic jack as shown in FIG. 12. Of course, the lower cup can be replaced by three rods 338 placed at the apex of a triangle and connected by a flexible attachment 339 to a ring 3310 which has a hollow to take a suction cap 3311. This suction cap 3311, when joined with a tube 3312 placed under vacuum, provides a suction effect with the lower part of the can body 1. In FIG. 12, suitable seals have been shown by 3314 and 3314*a*.

As an example, which is of course non-restrictive, the sucker cap 3311 and the tube 3312 may form only one part having only one seal 3314. The set has been presented in separated form with a view to automated installation. The can of the invention, assembled but not crimped, then rises towards the upper cup 3315 which presses the connecting ring 3555 into the can body 1. An elastic skirt 3316 surrounds both the upper cup 3315 and the push-back jaws 3317 actuated by corresponding jacks 3318, making it possible then to provide temporary imperviousness. A tap 3319, made in the upper cap 3315 then provides for setting up a vacuum in the entire can while the crimping or push-back operation raises the support of the fixed case 355B and the support of the movable case 336 against the inlet seal 3320 since the can body 1 can no longer come down. A holding counterplate 3321 of the inlet seal 3320 provides for the holding of this seal. The upper cup 3315 and the counterplate 3321 are engaged in the inlet ring 3322, which has its imperviousness to vacuum also provided by the sealing elastic skirt 3316. The viscous product or substance to be dispensed in the can is let in through an inlet nozzle marked 3323, the inlet of the above-mentioned viscous substance being controlled by the inlet valve 3324.

Numerous inlet and outlet possibilities have also been shown at 3325 and 3326 to set up a vacuum in the external vicinity of the container case 2. The screwdriver and knob 3327 and 3328 penetrate the volume put under vacuum, with the sealing elastic skirt 3316 providing imperviousness. The withdrawal or release of the movable support of the case 336 and the opening of the inlet valve 3324 then enable either the inlet of the product which is to be packed, namely the viscous substance to be packed and dispensed, or the inlet of the rinsing/-sterilizing product and then the inlet of hot drying air.

In the latter case, the opening and closing of the vacuum then makes it possible to suck in and then expel the product or products which may leave by their inlet channel or by a specific outlet to be recycled if need be. After the drying of the container case 2, the main product or viscous substance to be dispensed reaches this container case 2 through the opening of the valve 3324. The filling is then done by suction and can be completed by putting the product or viscous substance to be dispensed under pressure. The closing of the valve 3324 causes the vacuum to be broken and the jacks supporting 3311 and 3312 come down again. The vacuum of the tube 3312 is then broken and, in an automatic system, the tube 3312 and the centering cone 3313 of this tube on the sucker cap 3314 are completely released from the ring forming a cup 3310 to leave space for the next ring, bringing another box or body of a can.

We have thus described a dispensing can for a viscous substance which is especially efficient inasmuch as it enables the assembly, washing, sterilizing and drying of each can immediately before it is filled with viscous substance to be dispensed, using the same machine. Furthermore, the can, of the invention, for packaging and dispensing viscous substances is especially advantageous inasmuch as long-lived operation is got for the elastic blades 231, 232, because of the shielding element provided for this purpose.

What is claimed is:

1. A dispensing can for viscous substances comprising:

a can body;

a container within said can body for containing the substance to be dispensed;

said container being formed of a flexible material and having a displaceable wall;

a dispensing head having a dispensing nozzle;

means carried by said can for selectively opening and closing said nozzle;

pressure means for exerting permanent continuous pressure to said container wall of said container when a substance is present in said container, said wall being displaced in response only to opening said nozzle to dispense the substance from said dispensing head, said pressure means comprising elastic means supported on the internal wall of said can body, said elastic means including two elastic blades forming springs disposed on opposite sides of the flexible container, a lateral edge of each elastic blade being supported against an internal wall of said can body to such that said springs form a deformable case for housing said flexible container therebetween.

2. A can supporting to claim 1 wherein said container is formed of a plurality of walls formed of an elastic flexible material which, when the viscous substance is disposed within the container, are placed under mechanical tension by elastic tension of said walls.

3. A can according to claim 1 wherein said container is formed of a flexible material compatible with the viscous substance, said flexible material comprising an elastomer material.

4. A can according to claim 3 wherein said container has an upper end formed of flexible material, a tip connected to the upper end of said container and to the dispensing head for transmitting the viscous material to the head for dispensing from the head through said nozzle.

5. A can according to claim 4 wherein said dispensing head comprises a shutter cap for the can body, said cap having said dispensing nozzle for the viscous substance connected to said tip and a valve.

6. A can according to claim 5 wherein the dispensing nozzle for the said viscous substance includes means including said selective means for adjusting the nozzle to control the flow of viscous substance through the nozzle.

7. A can according to claim 6 wherein said adjustable means comprises:

a cylindrical tube having a slit of predetermined width; and a shutter for said slit for opening and closing said slit.

8. A can according to claim 7 wherein said shutter comprises:

an open cylindrical sleeve-shaped part with lateral edges having at one of its lateral edges, an actuator, said open cylindrical sleeve-shaped part being adapted to rotate around said cylindrical tube so that, upon actuation of said actuator, the slit made in said cylindrical tube can be opened or closed by rotation of said part, and a return spring supported on the shutter cap of the can body and coupled to said actuator for maintaining said slit closed when said actuator is not actuated.

9. A can according to claim 8 wherein said open cylindrical sleeve-shaped part has a shutter edge with at least one part inclined with respect to the longitudinal axis of said slit whereby the viscous substance can be dispensed over selected defined flow widths in accordance with the rotational position of said part relative to said slit.

10. A can according to claim 9, wherein said shutter edge has two oppositely inclined parts forming a chevron shape, the two inclined parts having substantially identical lengths and connected one to the other by a notch, the size of said notch corresponding substantially to the thickness of the slit.

11. A can according to claim 8 wherein said open cylindrical sleeve-shaped part has representative graduations indicative of the width dimension of the slit.

12. A can according to claim 8 wherein the longitudinal axis of the cylindrical tube and that of the open cylindrical sleeve-shaped part is perpendicular to the longitudinal axis of the dispensing nozzle.

13. A can according to claim 8 wherein said open cylindrical sleeve-shaped part is received about said cylindrical tube, and means for including two lateral guides for sealing said part and said tube one to the other.

14. A can according to claim 7 wherein the longitudinal axis of the cylindrical tube and of the open cylindrical sleeve-shaped part is coaxial with the longitudinal axis of the viscous substance dispensing nozzle.

15. A can according to claim 14 wherein the open cylindrical sleeve-shaped part and the cylindrical tube have a diameter which is far greater than the diameter of the dispensing nozzle so as to define a space between the dispensing nozzle and said open cylindrical sleeve and said cylindrical tube, said space forming a buffer container.

16. A can according to claim 15 wherein said buffer container comprises two circular shutter walls, a first of said walls forming a bottom of the buffer container and having a through hole and a second of said two walls forming a lid of the buffer container and having a blind hole, said through hole and said blind hole having a diameter adapted to receive said dispensing nozzle.

17. A can according to claim 16 wherein said second of said two walls forming a lid is provided with a valve which is directly connected to the dispensing nozzle, said valve having an external tip enabling the filling of said flexible container with a viscous substance.

18. A can according to claim 1 wherein the can body is formed of a rigid or semi-rigid material.

19. A can according to claim 18 wherein said can body includes at least one vent.

20. A can according to claim 19, in which said at least one vent is provided with a valve.

21. A can according to claim 1 wherein each elastic blade has lateral edges which comprise an enlargement with a rounded section.

22. A can according to claim 1 wherein, in order to reduce shearing strains at the lateral edge of the elastic blades on the internal wall of the can body, said can further has a shielding frame for said internal wall in which said elastic blades are housed.

23. A can according to claim 22 wherein the shielding frame consists of a support with a substantially square section, the apexes of which are supported on the internal wall of the body of the can, said elastic blades being mounted along a diagonal of the substantially square section.

24. A can according to claim 22 wherein the shielding frame consists of a support extending through at least a portion of the length of the can body. .

25. A can according to claim 22 wherein the dispensing head of said substance is an injected plastic material.

* * * * *